US005531142A

United States Patent [19]

Adamo

[11] Patent Number: 5,531,142

[45] Date of Patent: Jul. 2, 1996

[54] DEVICE WITH AUTOMATIC FEEDER FOR DRIVING RIBBON-MOUNTED SCREWS

[75] Inventor: Giuseppe Adamo, Bologna, Italy

[73] Assignee: Nikema S.r.l., Sala Bolognese, Italy

[21] Appl. No.: 402,215

[22] Filed: Mar. 10, 1995

[30] Foreign Application Priority Data

Mar. 22, 1994 [IT] Italy ..... BO94A0122

[51] Int. Cl.[6] ..... B25B 23/06

[52] U.S. Cl. ..... 81/434; 81/435; 227/120; 227/136

[58] Field of Search ..... 81/434, 435, 57.37; 227/120, 123, 135, 136

[56] References Cited

U.S. PATENT DOCUMENTS 4,014,225 3/1977 Lejdegard .

5,186,085 2/1993 Monacelli ..... 81/434

5,402,695 4/1995 Hornung ..... 81/434

FOREIGN PATENT DOCUMENTS 2132531 7/1984 United Kingdom .

*Primary Examiner*—James G. Smith

*Attorney, Agent, or Firm*—Guido Modiano; Albert Josif

[57] ABSTRACT

A device with automatic feeder, for driving ribbon-mounted screws comprising a guide in front of which a box-like body is mounted so that it can slide longitudinally; moreover the body has a shallow seat for the sliding of the ribbon which is connected to a longitudinal hole for positioning the first screw and for the longitudinal sliding of the shank of the screwing tool and can be closed, in an upward region, by a sort of lid which is pivoted to the body and can be locked by means of a sliding bolt in the seat covering position; the seat is crossed by a lower tooth for retaining the first screw which is associated with a lever system; and a spring latch is mounted in the lid and is actuated so as to oscillate.

6 Claims, 4 Drawing Sheets

DEVICE WITH AUTOMATIC FEEDER FOR DRIVING RIBBON-MOUNTED SCREWS

BACKGROUND OF THE INVENTION

The present invention relates to a device with automatic feeder for driving ribbon-mounted screws.

Conventional electric screwing tools are equipped with an automatic feeder that is adapted to work with screws that are mounted side by side on a ribbon made of a material such as plastics: in conventional loaders, the first screw to be driven is usually kept aligned with the screwing tool by acting on the second screw: usually the second screw is kept aligned by means of a tip element which, when the loader is pressed towards the part into which the screw must be driven, is in turn pressed against the tip of the second screw: it is thus impossible to drive the last screw at the end the ribbon (as there is nothing that could keep it aligned).

Moreover, in conventional loaders, in order to reach the region where the ribbon slides and to adjust the driving depth and the length of the screw it is necessary to act on elements that must be operated with wrenches or in any case to carry out operations that require a considerable waste of time.

SUMMARY OF THE INVENTION

A principal aim of the present invention is to obviate the described drawbacks of conventional devices, by providing a device with automatic feeder for driving ribbon-mounted screws that is capable of acting even on the last screw of the ribbon and in which it is possible to reach the ribbon sliding region and to perform the various adjustments without requiring tools and in a simple and quick manner.

Within the scope of this technical aim, an object of the present invention is to achieve the above aim with a device that is simple, relatively easy to provide in practice, safe in use, effective in operation, and relatively inexpensive.

This aim and this object are both achieved by the device, according to the present invention, for driving ribbon-mounted screws with automatic feeder, of the type which comprises a guide which is provided with means for fitting it in front of a screwing tool and in front of which a box-like body is mounted so that it can slide longitudinally in contrast with elastic means, characterized in that said box-like body has a shallow seat for the sliding of the ribbon which is connected, along one side, to a longitudinal hole for positioning the first screw and for the longitudinal sliding of the shank of the screwing tool and can be closed, in an upward region, by a sort of lid which is pivoted to the body and can be locked by means of a sliding bolt in the seat covering position; in that said seat is crossed by a transverse slot for the passage of a lower tooth for retaining the first screw, said tooth being associated with a lever system that is adapted to move the tooth below the second screw during the relative retraction of the body during screwing and to move the second screw into said hole during the relative advancement of the body; in that a spring latch is mounted in said lid, is actuated so as to oscillate, and is adapted to retain the second screw while the first tooth passes below it and to allow the translatory motion of the second screw in the hole, keeping it aligned.

BRIEF DESCRIPTION OF THE DRAWINGS

Further features will become clearly apparent from the following detailed description of a preferred but not exclusive embodiment of a device for driving ribbon-mounted screws with automatic feeder, according to the invention, illustrated only by way of non-limitative example in the accompanying drawings, wherein.

DESCRIPTION OF THE PREFERRED EMBODIMENTS

Figure 1:
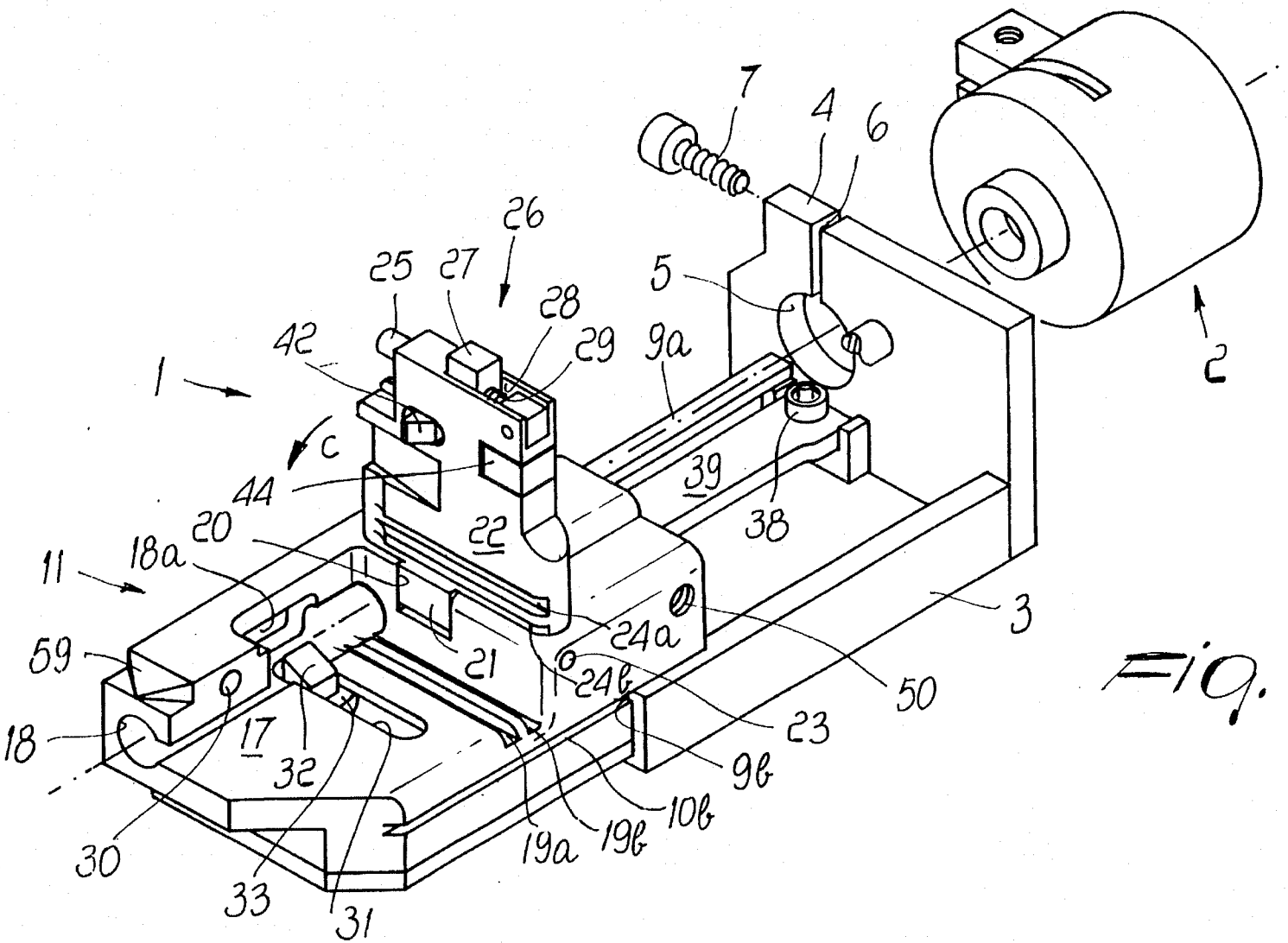
FIG. 1 is a perspective view of a device for driving ribbon-mounted screws with automatic feeder according to the invention.
Figure 2:
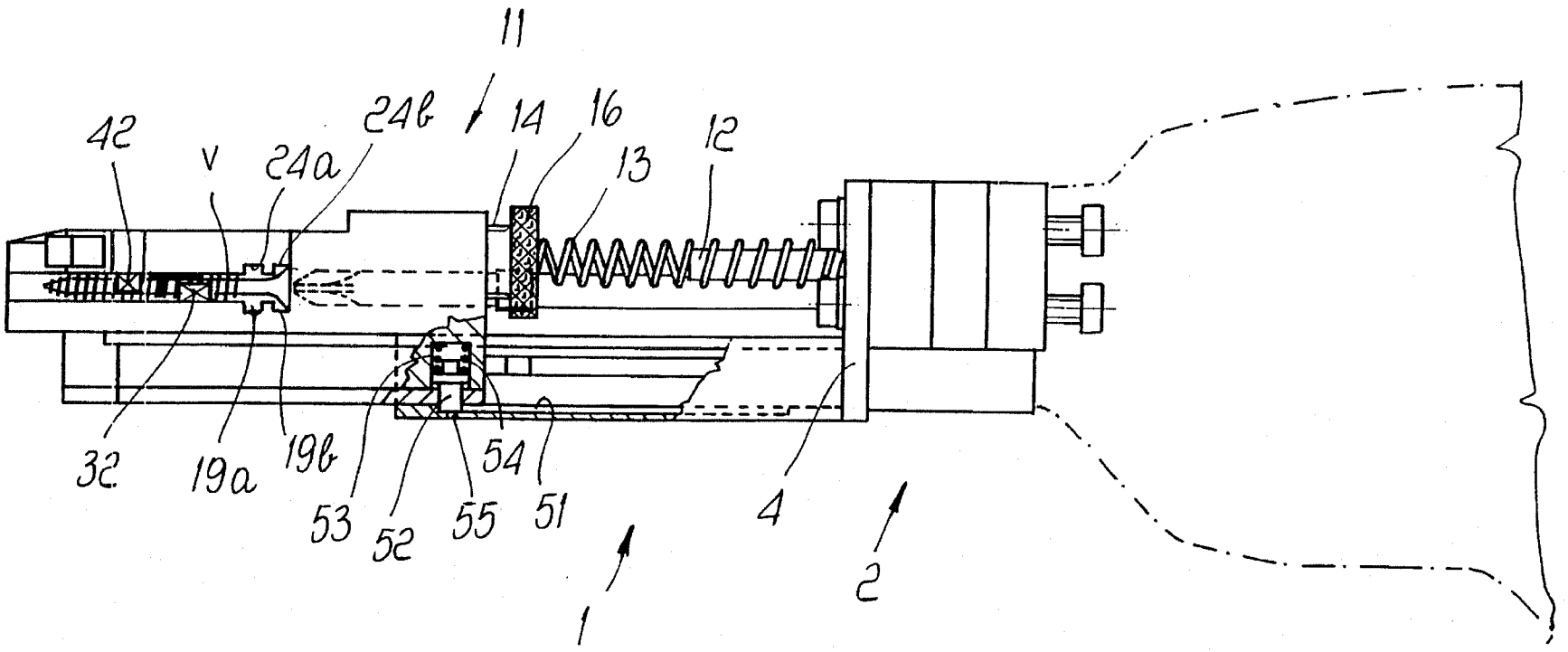
FIG. 2 is a partially sectional cutout side view of the device.
Figure 3:
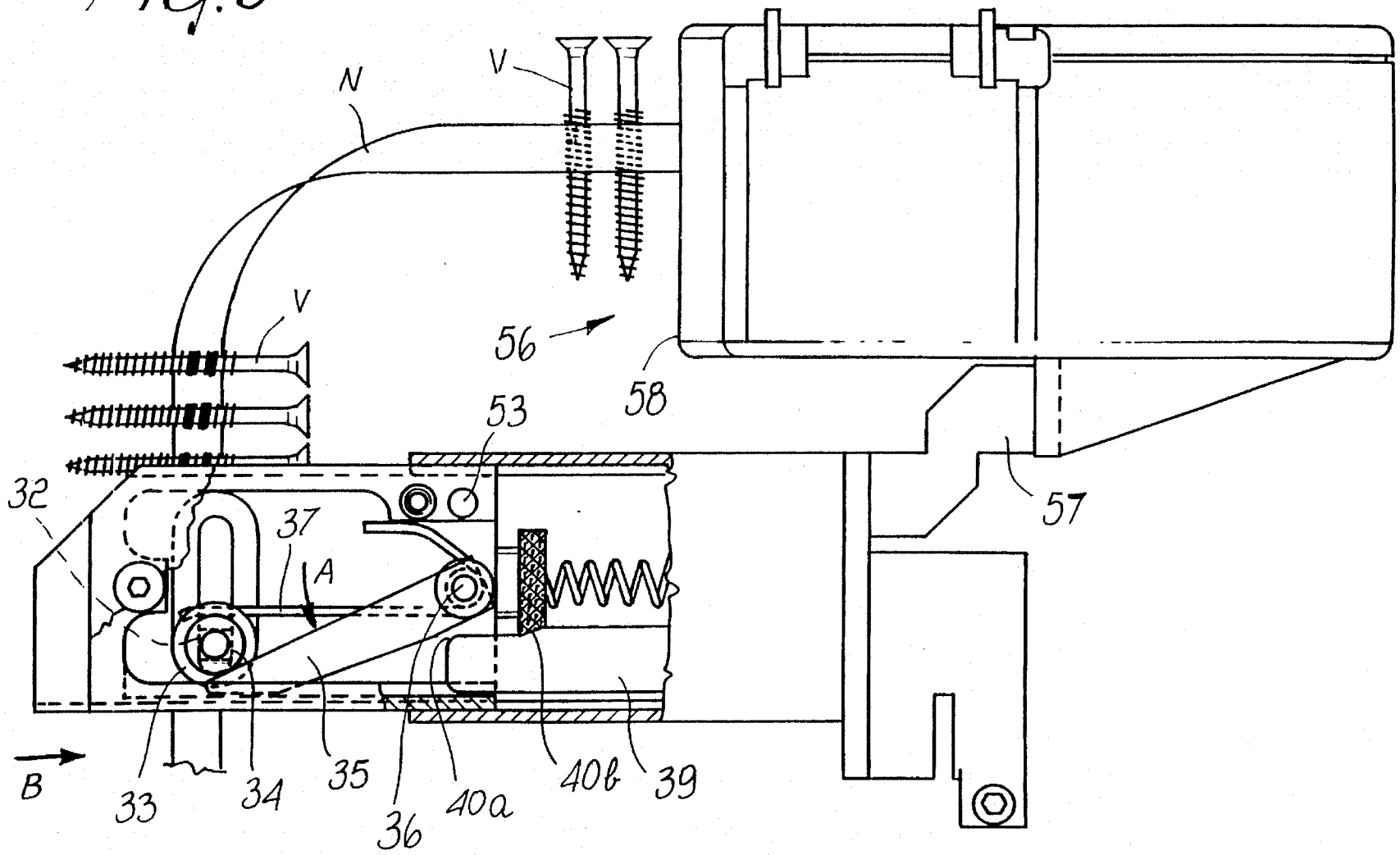
FIG. 3 is a partially sectional cutout bottom view of the device.
Figure 5:
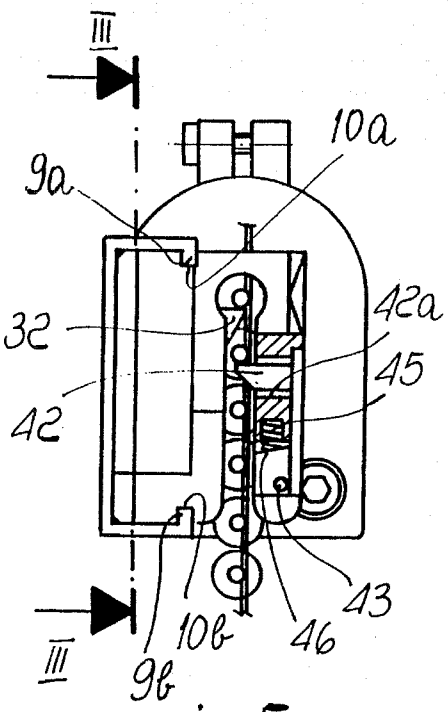
FIG. 5 is a sectional view, taken along the plane V—V of FIG. 4.
Figure 4:
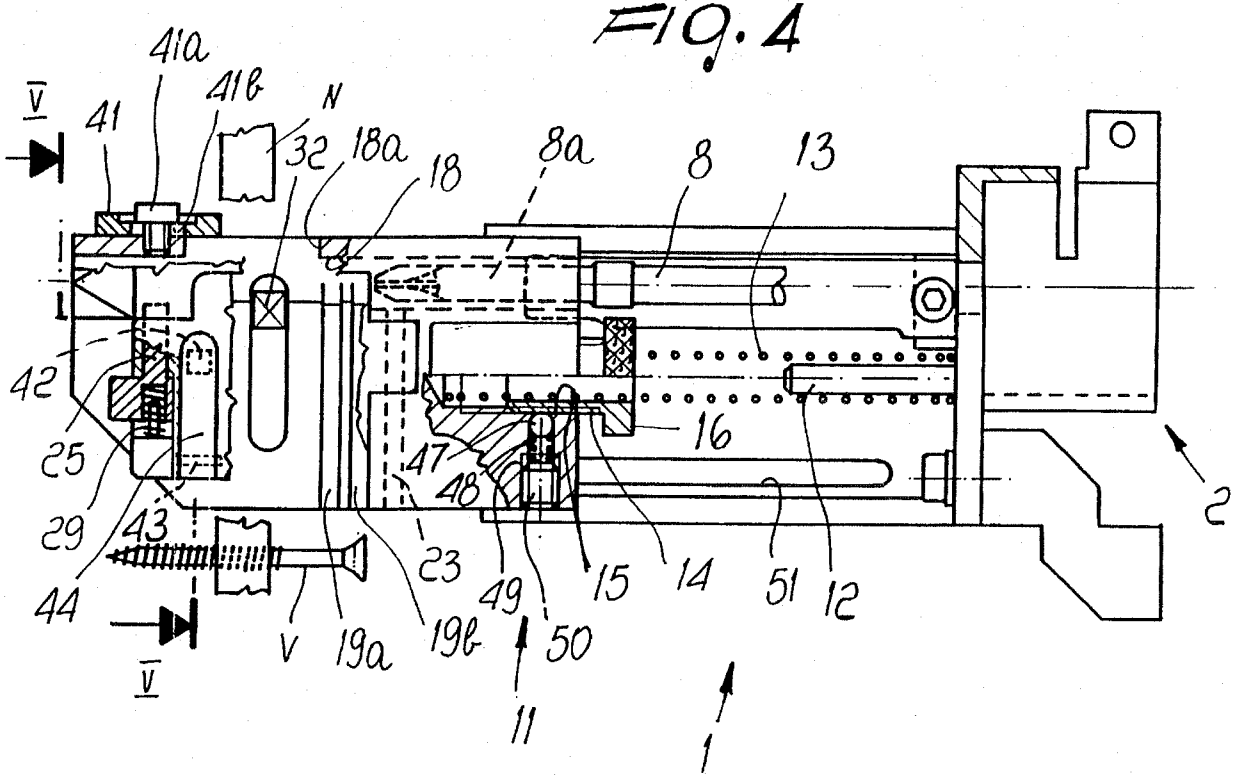
FIG. 4 is a partially sectional cutout top view of the device.

With particular reference to the above figures, the reference numeral 1 generally designates a device, according to the invention, for driving ribbon-mounted screws with automatic feeder for a screwing tool 2, which is adapted to work with screws V that are mutually joined by a long ribbon N made of a material such as plastics.

The device 1 comprises a guide 3 which ends, at one end (as shown in FIG. 1), with a flat front 4 that is crossed by a hole 5 provided with a slot 6 and a locking screw 7 that constitute means for mounting it in front of the screwing tool 2, which has a screwing shank 8 that ends with an interchangeable screw blade 8*a*; in alternative (FIGS. 2, 3, 4, and 5), the flat front 4 is welded to the screwing tool 2 to form a monolithic body.

In cross-section, the guide 3 is substantially shaped like a broad and flat letter U whose edges end with opposite ribs 9*a*, 9*b* that are adapted to cooperate with corresponding lateral slots 10*a*, 10*b* of a shallow box-like body 11 to allow the longitudinal sliding of the body 11.

The front 4 has a stem 12 on which the end of a helical compression spring 13 is centered; the other end of said spring is inserted in a bush 14 for adjusting the driving depth: the bush 14 is screwed into a rear threaded hole 15 of the body 11, has an end 16 which has a larger diameter and is advantageously knurled for manual actuation, and is adapted to abut against the flat front 4 and act as stroke limiter for the backward motion of the body.

The body 11 has a shallow seat 17 for the sliding of the ribbon N provided with screws V; said seat is connected, along one side, to a longitudinal hole 18 for positioning the first screw and for the longitudinal sliding of the shank of the screwing tool: the seat 17 has, towards the end that faces the screwing tool, a pair of slots 19*a* and 19*b* in which the heads of the screws V are accommodated, using one slot or the other depending on the size of the screws.

The body 11 has, at the edge of the seat 17, a square recess 20 in which the centrally protruding end 21 of a sort of lid 22 can be snugly fitted: the recess 20 and the end 21 have corresponding holes and are crossed by a transverse pivot 23 so as to hinge the lid 22 to the body 11: the lid too has, on its lower face, transverse slots 24*a* and 24*b* that cooperate with the slots 19*a* and 19*b* to keep the screw heads guided.

At its free end, the lid is crossed by a transverse hole for the stem 25 of a sliding bolt 26 that has an actuation lever 27 which protrudes from a front slot 28 of the lid and has a compression spring 29 that is adapted to push outward the stem 25 so that it enters a corresponding hole 30 of the body 11 to couple the lid to the body in the active configuration.

The base of the seat 17 is crossed by a transverse slot 31 for the passage of a saw-tooth element 32 for retaining the first screw: below the seat, the saw-tooth element is rigidly coupled to a mushroom-shaped stud or pad 33 with a narrower central stem 34 which is associated with a lever system 35 whose end is pivoted to the body 11 by means of the pivot 36; elastic means, constituted by a coil spring 37 centered on the pivot 36, are adapted to keep said stud pressed in the direction of the arrow A; a profile 39 is fixed longitudinally to the guide 3 by means of a screw 38 and has, at the front, two contoured portions 40*a* and 40*b* which are adapted to act on the lever system to move the saw-tooth element (in the opposite direction with respect to the arrow A) below the second screw during the relative retraction (arrow B) of the body with respect to the guide during screwing and to move the second screw into the hole 18 (direction of the arrow A) during the relative advancement of the body 11 during the movement of the screwing tool away from the part into which the screw has been driven (in the opposite direction with respect to the arrow B): the ribbon N, freed of the screw, exits from the box-like body 11 through the lateral slot 18*a* of the hole 18 and also acts as element for centering and aligning the first screw in the hole 18; in order to compensate for the possible different types of ribbon, a plate 41 provided with a longitudinal positioning slot 41*b* is mounted in front of the slot 18 so that it can slide and be locked by means of a screw 41*a*.

A spring latch 42 is mounted in the lid 22 and is actuated so that it can oscillate; said spring latch is shaped like a saw-tooth and is supported at the end of an arm 42*a* which is pivoted, by means of a pivot 43, in a seat 44 of the lid and is pressed by a helical compression spring 45 in the direction along which said spring latch protrudes from the lower face of the lid (arrow C): the spring 45 is accommodated in a seat of the lid that lies substantially at an angle with respect to the pivot 43 and presses against a small flat surface 46 of the arm of the spring latch; the spring latch 42 is adapted to stop the second screw while the first saw-tooth 32 passes beneath it and to allow the translatory motion of the second screw into the place previously occupied by the first screw.

In order to avoid the spontaneous rotation of the bush 14, the threaded outer surface of the bush is affected by multiple flat facets against which a ball 47 can press; said ball is mounted so that it can move under the action of a compression spring 48 in a hole 49 of the box-like body which is closed by a grub screw 50.

The sliding stroke of the body 11 along the guide 3 is limited by means of an elongated slot 51 which is formed longitudinally with respect to the guide and in which a pin 52 slidingly fits; said pin is mounted, so that it can slide axially, inside a hole 53 of the base of the body 11 and is pushed outward by a compression spring 54: at the end of the slot 51 there is a small hole 55 in which a pointed object can be inserted to retract the pin 52 and release the body 11.

A screw magazine 56 is mounted on one side of the loader 2, is coupled to said loader by means of a bracket 57, and is substantially shaped like a drum with a horizontal axis at right angles to the vertical plane of arrangement of the shank 8; the ribbon N with the screws V exits from a front slot 58 of the magazine 56.

Above the hole 18, the body 11 has a pyramid-shaped point 59 which visually indicates from above the point from which the screw V will exit.

The operation of the device for driving ribbon-mounted screws with automatic feeder according to the invention has been presented in detail during the description.

It should be noted that centering of the screw to be driven is provided on the screw itself (by means of the saw-tooth 32) and on the ribbon N (by means of the plate 41): the driving depth is adjusted by means of the bush 14, and adaptation to the various types of ribbon N is provided by means of the plate 41.

It has thus been shown that the invention achieves the intended aim and objects.

The invention thus conceived is susceptible of numerous modifications and variations, all of which are within the scope of the inventive concept.

All the details may furthermore be replaced with other technically equivalent ones.

In practice, the materials employed, as well as the shapes and dimensions, may be any according to the requirements without thereby abandoning the scope of the protection of the claims that follow.

What is claimed is:

1. Device with automatic feeder for driving ribbon-mounted screws, comprising:

a guide being mountable in front of a screwing tool;

elastic means provided on said guide;

a box-like body being mounted on said guide, said body being slideable on said guide in contrast with said elastic means;

a shallow seat provided at said body for allowing a sliding of a ribbon on which screws are mounted;

a longitudinal hole for positioning a first screw, said hole further allowing a longitudinal sliding of a shank of the screwing tool, and said longitudinal hole being connected to said shallow seat along a side thereof;

a lid being pivoted to said body, said lid being lockable for covering said seat;

a sliding bolt for locking in a covering position said lid over said seat;

a transverse slot which crosses said seat;

a tooth element passing through said slot for retaining with a lower tooth thereof a first screw;

a lever system for moving said tooth element below a second screw during a relative retraction of the body during screwing and for moving the second screw into said hole during a relative advancement of the body;

a spring latch mounted in said lid, said latch being actuatable for retaining the second screw while said lower tooth of said tooth element passes below said second screw, and respectively for allowing a translatory motion of the second screw in said hole, said latch keeping aligned said second screw during the translatory motion.

2. Device according to claim 1, wherein a bush for adjusting a driving depth is screwable at a rear part of said box-like body, said bush being locatable in abutment against an end of said guide, said bush acting as stroke limiter for a retraction of the body.

3. Device according to claim 1, wherein said tooth element is saw-tooth shaped.

4. Device according to claim 1, wherein said longitudinal hole of the body for the sliding of the screw and of the shank of the screwing tool has, on one side, a slot for the exit of the ribbon.

5. Device according to claim 4, wherein a ribbon supporting plate is adjustably mounted in front of said slot in the body.

6. Device according to claim 1, wherein said tooth is rigidly coupled to a pad, said pad being associated with a lever system, an end of said lever system being pivoted to the body, a longitudinal profiled element being further provided to slide along said body for acting on said lever system, said profiled element being rigidly coupled to said guide.

* * * * *